US005464728A

United States Patent [19]

Szajewski et al.

[11] Patent Number: 5,464,728

[45] Date of Patent: Nov. 7, 1995

[54] METHOD OF BLEACHING AND FIXING A COLOR PHOTOGRAPHIC ELEMENT CONTAINING HIGH IODINE EMULSIONS

[75] Inventors: Richard P. Szajewski; John M. Buchanan, both of Rochester, N.Y.

[73] Assignee: Eastman Kodak Company, Rochester, N.Y.

[21] Appl. No.: 998,157

[22] Filed: Dec. 29, 1992

[51] Int. Cl.[6] ..... G03C 7/42

[52] U.S. Cl. ..... 430/393; 430/372; 430/428; 430/479; 430/430; 430/943

[58] Field of Search ..... 430/393, 428, 430/429, 430, 455, 460, 461, 372, 943, 567

[56] References Cited

U.S. PATENT DOCUMENTS

| | | | |
|---|---|---|---|
| 3,870,520 | 3/1975 | Shimamura et al. | 96/60 R |
| 4,292,401 | 9/1981 | Itoh et al. | 430/393 |
| 4,448,878 | 5/1984 | Yamamuro et al. | 430/507 |
| 4,458,010 | 7/1984 | Yamamuro et al. | 430/393 |
| 4,481,290 | 11/1984 | Kishimoto et al. | 430/593 |
| 4,506,007 | 3/1985 | Nakajima et al. | 430/393 |
| 4,508,816 | 4/1985 | Yamamuro et al. | 430/393 |
| 4,745,048 | 5/1988 | Kishimoto et al. | 430/460 |
| 5,183,727 | 2/1993 | Schmitton et al. | 430/372 |
| 5,318,880 | 6/1994 | English et al. | 430/393 |

FOREIGN PATENT DOCUMENTS 2554861 6/1976 Germany .

OTHER PUBLICATIONS

"Kodak Persulfate Bleach For Process ECN–2", Society of Motion Picture & Television Engineers Journal, vol. 91, p. 1058, (Nov., 1982).

"Abridged Specifications For Process RVNP Using Kodak Packaged Chemicals", Eastman Kodak Company Publication H–12, (1979).

"Abridged Specifications For Process ECN–2", Eastman Kodak Company Publication H–36, (1984).

*Primary Examiner*—Charles L. Bowers, Jr.
*Assistant Examiner*—J. Pasterczyk
*Attorney, Agent, or Firm*—Sarah Meeks Roberts; J. Lanny Tucker

[57] ABSTRACT

This invention provides a method of processing a developed high iodide color silver halide photographic element by bleaching the element with a peracid bleach and fixing the element with a fixer containing sodium cation and thiosulfate, wherein the amount of ammonium ion in the fixer is less than 1.4M.

16 Claims, No Drawings

METHOD OF BLEACHING AND FIXING A COLOR PHOTOGRAPHIC ELEMENT CONTAINING HIGH IODINE EMULSIONS

This invention is related to co-pending, commonly assigned, U.S. application Ser. No. 07/891,601, English et al., filed Jun. 1, 1992.

FIELD OF THE INVENTION

This invention relates to the processing of color silver halide photographic recording elements. More particularly, it relates to the desilvering of a color silver halide photographic element using a peracid bleach and a sodium thiosulfate fixing agent.

BACKGROUND OF THE INVENTION

The basic image-forming process of color photography comprises the exposure of a silver halide photographic recording material to light, and the chemical processing of the material to reveal a useable image. The chemical processing entails two fundamental steps. The first is the treatment of the exposed silver halide with a color developer wherein some or all of the silver halide is reduced to metallic silver while an organic dye is formed from the oxidized color developer. The second is the removal of the silver metal thus formed and of any residual silver halide by the desilvering steps of 1) bleaching, wherein the developed silver is oxidized to silver salts; and 2) fixing, wherein the silver salts are dissolved and removed from the photographic material. The bleaching and fixing steps may be performed sequentially or as a single step.

It is highly desirable to process a photographic recording material as rapidly as possible, and an accelerated process is constantly being sought. In particular, shortening the silver removal step, which consumes almost half of the total process time, is an attractive way in which to shorten the overall processing time.

Juxtaposed to the desire for an accelerated process is the desire for, and the need for, photographic elements and process solutions that require lower chemical usage and that generate less polluting chemical waste. Used or spent fixer solutions are desilvered by electrochemical means to recover the semi-precious metal, but these solutions may still contain ingredients that limit their direct discharge into public waste water streams. Further treatment is required for them to conform to standards for environmentally acceptable disposal. In some photographic processes, higher processing speed can be traded for an indirect advantage in the form of lower processing chemistry usage and lower processing waste per unit of photographic material processed. Thus, these desires or goals are interrelated.

Numerous materials and methods suitable for the bleaching of metallic silver deposits have been described. Chief among the more useful bleaching or oxidizing agents are the higher oxidation states of various metals such as cerium, magnesium, chromium, vanadium, and iron, and the peracids, which include peroxide, persulfate, and their salts. The peracid bleaches may require the presence of a bleach accelerator to enable adequate bleaching. Likewise, many materials and methods suitable for the fixing or dissolution of silver salts and their removal from films are also known.

Commonly used fixing agents are the various salts of thiosulfate and thiocyanate, although other silver complexing anions have also been employed from time to time. This field of endeavor is generally reviewed in T. H. James, ed.,*The Theory of the Photographic Process*, Macmillan, New York, 1977, and in particular at Chapter 15, entitled "Complementary Processes", pages 437 to 461 of this text. Additional teachings are shown at *Research Disclosure*, December 1989, item 308119, published by Kenneth Mason Publications, Ltd., The Old Harbourmaster's, 8 North Street, Emsworth, Hampshire P010 7DD, England, and in particular, at Section XIX, entitled "Processing" of this publication.

For reasons related to cost and efficacy, the photographic processing industry has focused on the use of chelated iron bleaches and thiosulfate fixers for the desilvering of color photographic materials. It is well appreciated in the art that the benefits of thiosulfate fixers are enhanced in the presence of ammonium ion. Fixer solutions containing ammonium thiosulfate are more active and solubilize silver halide in a photographic element more rapidly than thiosulfate salts of other cations. Thus, owing to its rapid fixing action, ammonium thiosulfate is widely used as a photographic fixing agent.

In recent years, however, the need to provide diminished environmental impact from photographic processing solutions has led to increased interest in means of rendering photographic bleaches and fixers ecologically benign. A useful means for making photographic fixer solutions environmentally more acceptable, including those fixer solutions which employ thiosulfate anion as a fixing moiety, has been substituting sodium ion for ammonium ion as the cationic counterion in the fixer solution. The reduction or total removal of the more common ammonium ion from the processing solution enables reduced aquatic toxicity and reduced biological oxygen demand in wastewater streams. Use of sodium thiosulfate fixing agents has been disclosed, for example, in U.S. Pat. No. 2,195,405 and in the *Theory of the Photoaraphic Process* and *Research Disclosure* cited above.

This substitution of sodium ion for ammonium ion is, however, commercially undesirable since sodium thiosulfate tends to be a poorer fixing agent than ammonium thiosulfate and thus requires either higher concentrations of fixing agent or longer fixing times to enable adequate silver salt dissolution. Various solutions to this problem have been disclosed. Specific processes utilizing color photographic recording materials comprising tabular grain emulsions with sodium thiosulfate fixer solutions to enable improved fixing are disclosed in co-pending U.S. patent application Ser. No. 07/747,895 entitled "Color Photographic Recording Material Processing" filed Aug. 19, 1991. Other attempts have been made to shorten the fixing process using various fixing accelerators.

Many combinations of sequential bleaching and fixer solutions and unitary bleach-fix solutions have been disclosed over the years. Typical examples are shown in the *Research Disclosure* and *Theory of the Photographic Process* cited above. With the current emphasis on ecologically sound processing, processes which utilize peracid bleaches are especially preferred since these bleaches tend to have a low environmental impact. A specific process utilizing a photographic recording material comprising high tabularity tabular grain emulsions in combination with peracid bleaches is disclosed in co-pending U.S. patent application Ser. No. 07/891,601 entitled "Method of Processing A Photographic Element With A Peracid Bleach," filed June 1, 1992.

It is known in the art that films with a high iodide content are more difficult to fix as discussed in British Patent 1,476,330 (p. 1, lines 50–58) and U.S. Pat. No. 4,960,683

(col. 16, line 18–28) Therefore, lowering the iodide content of a silver halide photographic element will increase its rate of fixing. It is often desirable, however, to have a higher iodide content in a photographic element, particularly in color negative systems. The high iodide content can enable improved blue light absorption and improved blue speed. High iodide phases in individual grains are also said to enable improved conversion of absorbed light into latent image thus further improving sensitivity.

A process which includes the ecological advantages of both a peracid bleach and a sodium thiosulfate fix is highly desirable; however, such a process has been thought to sacrifice speed in desilvering. This is especially true for the high iodide photographic elements. Photographic processes utilizing both a persulfate bleach solution, a species of peracid bleach, and a sodium thiosulfate fixer solution are incidentally disclosed as examples in U.S. Pat. Nos. 4,448,878; 4,481,290; 4,458,010; 4,506,007 and 4,508,816. These publications are directed at bleaching improvements and disclose numerous combinations of different bleaches with various fixers.

The sodium thiosulfate fixer solutions, incidentally illustrated in these publications, are used at high concentrations and long fixing times so as to ensure adequate fixing. These are exactly the fixing conditions that would be anticipated as useful based on the known inferiority of sodium thiosulfate as a fixitive agent. No mention is made of any differences in the fixing behavior of photographic recording materials as a result of the composition of the bleaching agent employed. There is no suggestion of any fixing benefit to be drawn from a photographic process combining any specific bleaching solution and a fixer solution comprising sodium thiosulfate. Further, the process described is utilized with low iodide photographic elements. There is no indication that such a process is particularly useful with high iodide elements.

There remains a need for an environmentally sound method of desilvering developed photographic images, particularly those with a high iodide content, without sacrificing the speed at which these images can be provided to a customer.

SUMMARY OF THE INVENTION

This invention provides a method of desilvering a developed color negative silver halide element, said method comprising bleaching the photographic element with a peracid bleach and subsequently contacting the photographic element with a fixer solution comprising thiosulfate anion and sodium cation;

wherein the photographic element has an iodide content of greater than 5.5 mole % based on incorporated silver; and wherein the fixer solution has an ammonium ion content less than 1.4M.

This invention provides a method of desilvering which is fast and environmentally sound. It is based on the discovery that a fixer using sodium thiosulfate actually fixes more efficiently when the bleach which is utilized is an environmentally desirable peracid bleach rather than an iron chelate bleach. Surprisingly, this is particularly true for those photographic elements having a high iodide content. This surprising increase in efficiency allows for lower concentrations of sodium thiosulfate in the fixer or shorter fixing times than expected by those skilled in the art. This will make it more desirable for the processing industry to use sodium thiosulfate fixers, which will reduce the amount of ammonium in the processing effluent. Thus, both steps of the desilvering process will be more environmentally benign.

DETAILED DESCRIPTION OF THE INVENTION

The photographic elements of this invention can be comprised of any mixture of chloride, bromide, and iodide, as long as the iodide content is at least 5.5 mole % of the incorporated silver. The mole % iodide content of a photographic element can be determined by direct measurement using, for example, atomic absorption spectroscopy. Alternatively, knowledge of the precipitation conditions for the individual silver halide emulsions and of the quantity of each type of emulsion enables ready calculation of the iodide mole % in a photographic product.

The incorporated silver is the sum of the silver employed as silver halide in both sensitized silver halide emulsions and in unsensitized silver halide emulsions as well as the metallic silver deposits incorporated as light filter materials. Especially preferred silver halides, for all the emulsions in the element, are silver bromoiodides and iodides. The iodide content may be up to the limit of iodide solubility in bromide. A preferred range is 5.5 mole % to approximately 40 mole %.

The silver halide emulsion layers in the photographic element may contain different levels of iodide, with the preferred range being from 0 to 40 mole %, and the most preferred range being 5.5 to 20 mole %. When mixed halides are used in the emulsion grain, the proportions of the halide can be uniform throughout the grain, or the proportions can vary continuously or discontinuously across the diameter of the grain, as in core-shell or multiple structure grains.

The emulsions of this invention can contain silver halide grains of any type of morphology, such as tabular, cubic, octahedral and conventional. Preferably, the grains are of conventional morphology or a mixture of tabular and conventional. Conventional emulsion morphology embraces emulsion morphologies having an aspect ratio of about 1 to 5. It encompasses both regular and irregular shaped silver halide crystals. Aspect ratio is the ratio of emulsion equivalent circular diameter to emulsion grain thickness.

The fixer solution contains thiosulfate anion and sodium cation. Preferably, the thiosulfate is present at a concentration from about 0.05M to about 3.0M, with 0.3M to 1.0M being preferred. The thiosulfate may be supplied by ammonium thiosulfate, sodium thiosulfate, potassium thiosulfate, lithium thiosulfate, magnesium thiosulfate, or calcium thiosulfate, or mixtures of these thiosulfates. Counterions to the thiosulfate may come from the thiosulfate or from other fixer ingredients.

Regardless of the source of the counterions, a portion of the counterions must be sodium. Preferably, at least 25% of the counterions are sodium, with at least 50% being more preferred. Preferably, all of the counterions are sodium, and the fixing agent is sodium thiosulfate.

The concentration of ammonium in the fixer solution of this invention is less than 1.4M, and more preferably, less than 0.9M. If ammonium ion is present, most preferably the concentration is less than 0.75M. The ammonium may come from the ammonium thiosulfate or from other fixer ingredients. The advantages of this invention are fully realized by utilizing a fixer solution that contains a low concentration of ammonium, or contains no or substantially no ammonium. For purposes of this invention, "substantially no ammonium" signifies the absence of ammonium intentionally added to the fixer formulation or intentionally added to a solution used to replenish the fixer during processing. Ammonium ion or ammonium species (collectively called "ammonium") which unintentionally occur as impurities, or which are carried into the fixer solution by color photographic recording material, may be present in the fixer.

The time of contact of the photographic element with the fixer solution is preferably 15 seconds to 600 seconds. Most preferably, the time of contact is 30 seconds to 300 seconds.

Other characteristics of the fixer solution are those that are typical of fixer solutions in the art. For example, the concentration of thiosulfate in the fixer solution can be from about 0.1 molar to as high as solubility in the processing solution allows, but it is preferred that this concentration be as described above. The pH of the fixer solution may range from about 3 to as high as about 12, but it is generally preferred that the pH be between 4 and 10. The fixer solution can optionally contain a source of sulfite or bisulfite ion. If the fixer solution is to be used at a pH below about 7, it is preferred to include a source of sulfite or bisulfite ion in the fixer solution. For example, sodium or potassium sulfite, sodium or potassium bisulfite, or sodium or potassium metabisulfite can be used. The concentration of this source of sulfite or bisulfite ion is generally from about 0.01 molar to about 0.5 molar. To control solution pH, various buffering agents may be used in the fixer solution, including the above-mentioned sulfite or bisulfite sources, acetate salts, citrates, tartrates, borates, carbonates, phosphates, etc.

In addition to thiosulfate and sulfite or bisulfite, the fixer solution can contain one or more other compounds known to be fixing agents. Such compounds include thiocyanate salts, thiourea and thiourea derivatives, organic thioethers and thioacids, thione compounds, thiosemicarbazones, organic thiols, amines, and imides. Patent and technical literature references to these and other compounds may be found in Chapter 59 of *Comprehensive Coordination Chemistry*, Vol. 6, G. Wilkinson, ed., Pergamon, Oxford, 1987.

If a film hardening action is desired for the fixer solution, it may contain one or more ingredients to effect film hardening and to stabilize the hardening agent in the fixer solution. Such ingredients include potassium alum, aluminum sulfate, aluminum chloride, boric acid, sodium tetraborate, gluconic acid, tartaric acid, citric acid, acetic acid and sodium acetate, for example.

The fixer solution may contain one or more substances which are known to accelerate film fixing. These materials are described in Chapter 15 of *The Theory of the Photographic Process*, 4th Edition, T. H. James, ed., Macmillan, New York, 1977. Such substances include ammonium salts, such as ammonium chloride (within the content limitations mentioned above), ethylenediamine, and other amines, such as guanidine, which are capable of providing organic ammonium cations that accelerate the fixing process. Other accelerators are thiourea and its derivatives.

The fixer solution may also contain compounds for the prevention of precipitation of metal salts of metals that are initially present in or that become introduced into the fixer solution during use. Such metals include iron, copper, zinc, magnesium, calcium, aluminum, and chromium, among others. Metal sequestering agents, chelating agents, and precipitation control agents may be used to control these metals. Examples of these metal control agents are polycarboxylic acids such as citric acid and tartaric acid; aminocarboxylic acids such as nitrilotriaacetic acid, ethylenedinitrilotetraacetic acid (EDTA), and diethylenetriaminepentaacetic acid; organophosphonic acids such as nitrilotris(methylenephosphonic) acid and 1-hydroxyethylidene-1,1-diphosphonic acid; orthodihydroxybenzene compounds such as 4,5-dihydroxy-m-benzenedisulfonic acid; acyclic or cyclic polyphosphates; and various polymers such as polyacrylic acids.

The concentrations of the fixer solution constituents during processing can be regulated by the usual controlling factors, namely, fixer replenishment rates and replenishing component concentrations, water losses due to evaporation, evaporative losses of volatile components other than water, the amounts and compositions of processing liquids carried into and out of the fixer solution by the photographic recording material, the amount of solution overflow from other vessels containing processing solutions that is introduced into the fixer solution, the amount of solid component carried into the fixer solution by the photographic recording material and then dissolved in the fixer solution, the rate of removal or replacement of any constituent by means such as ion exchange, electrolysis, electrodialysis, and the like.

Typical peracid bleaches useful in this invention include the hydrogen, alkali and alkali earth salts of persulfate, peroxide, perborate, perphosphate, and percarbonate, oxygen, and the related perhalogen bleaches such as hydrogen, alkali and alkali earth salts of chlorate, bromate, iodate, perchlorate, perbromate, and metaperiodate. Examples of formulations using these agents are described in *Research Disclosure*, December 1989, Item 308119, published by Kenneth Mason Publications, Ltd., Dudley Annex, 12a North Street, Emsworth, Hampshire P010 &DQ, England, the disclosures of which are incorporated herein by reference. This publication will be identified hereafter as *Research Disclosure*.

Additional hydrogen peroxide formulations are described in U.S. Pat. No. 4,277,556 (Jul. 7, 1981) of Koboshi et al.; U.S. Pat. No. 4,328,306 (May 4, 1982) of Idota et al.; PCT/EP91/01377 (filed July 24, 1991) of Marsden and Fyson; PCT/EP91/01973 (filed Oct. 17, 1991) of Fyson and Marsden; U.S. Pat. No. 4,454,224 (Jun. 12, 1984) of Brien and Hall; and U.S. Pat. No. 4,717,649 (Jan. 5, 1988) of Hall and Hastreiter. Especially preferred are persulfate bleaches and peroxide bleaches, with sodium, potassium, or ammonium persulfate being particularly preferred. For reasons of economy and stability, sodium persulfate is most commonly used. The bleaching agent can be present in any effective concentration. Preferred concentrations are from 0.01 to 1.0 moles/liter, more preferably from 0.05 to 0.5 moles/liter of bleaching agent.

Water is employed as a solvent for the bleaching solution. Both acid and alkaline peracid bleach solutions are known. If a persulfate bleach is used, the pH of the bleaching solution is maintained on the acid side of neutrality within conventional ranges, typically in the range of from about 1 to 7, more preferably from about 1.5 to 5, and most preferably from pH 2 to 4. The bleaching solution may contain a buffer consisting of an organic acid or inorganic acid and/or a salt thereof. Useful examples include phosphoric acid and salts of phosphate, citric acid and salts of citrate, boric acid and salts of borate or metaborate, acetic acid and salts of acetate, and carbonate. The bleaching solution may also contain a chloride salt such as sodium chloride, potassium chloride, or ammonium chloride, or a bromide salt such as sodium bromide, potassium bromide, or ammonium bromide.

Various compounds may be used to accelerate bleaching with these peracid bleaches. Representative compounds are disclosed in U.S. Pat. Nos. 3,707,374; 3,772,020; 3,820,997;

3,870,520; 3,893,858; 4,446,225; 4,458,010; 4,506,007; 4,508,816; 4,508,817; 4,578,345; 4,865,956; 5,011,763; *Research Disclosure No.* 20821 (1989); *Research Disclosure* No. 15704 (1977); DD 141,727; DE 3,234,467; DE 3,919,550; DE 3,919,551; JP 1,292,339. These materials may be used in a presolution, added to the persulfate solution, or coated in the photographic element in quantities sufficient to enable bleach acceleration. Examples of preferred accelerators include dimethylaminoethanethiol, dimethylaminoethanethiol isothiouronium salt, aminoethanethiol, and morpholinoethanethiol. When used in a presolution or in the bleaching solution itself, the accelerator may be used at a concentration of 0.002 to 0.2 moles/liter, with 0.005 to 0.05 preferred. When the bleach accelerators are incorporated in the photographic element, preferred accelerators are silver morpholinoethanethiol, silver aminoethanethiol, and silver dimethylaminoethanethiol, at a concentration of 0.05 to 0.5 g/m$^2$.

Scavengers for halogen may be added to the persulfate solution as disclosed in *Research Disclosure* No. 17556 (1978) and U.S. Pat. Nos. 4,292,401 and 4,293,639. Other useful discussions of the application of persulfate to photographic bleaching appear in the *Journal of the Society of Motion Picture and Television Engineers* (SMPTE), Vol. 91, pp. 158–163 (1982); *SMPTE*, Vol. 91, pp. 1058–1065; and Eastman Kodak Publication H-24, *Manual for Processing Eastman Color Films* (December, 1988).

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore, U.S. Pat. No. 4,362,806 issued Dec. 7, 1982.

The element can contain additional layers such as filter layers, interlayers, overcoat layers, subbing layers and the like. The total thickness of these light sensitive and additional layers will generally be between about 5 and 30 microns. Thinner formulations of about 5 to 25 microns are generally preferred since these are known to provide improved contact with the process solution. For the same reason, more swellable film structures are preferred. Further, the element may be particularly useful with a magnetic recording layer such as those described in *Research Disclosure* No. 34390, p. 869 (November, 1992), due to the decreased Dmin associated with peracid bleaches.

The silver halide emulsions employed in the elements of this invention are negative-working emulsions. Examples of suitable emulsions and their preparation are described in *Research Disclosure* Sections I and II and the publications cited therein. Some of the suitable vehicles for the emulsion layers and other layers of elements of this invention are described in *Research Disclosure* Section IX and the publications cited therein. The most useful photographic elements for this invention will contain less than 20 grams of silver per square meter of film.

The silver halide emulsions can be chemically and spectrally sensitized in a variety of ways, examples of which are described in Sections III and IV of the *Research Disclosure*. The elements of the invention can include various couplers including, but not limited to, those described in *Research Disclosure* Section VII, paragraphs D, E, F, and G and the publications cited therein. These couplers can be incorporated in the elements and emulsions as described in *Research Disclosure* Section VII, paragraph C, and the publications cited therein.

The photographic elements of this invention or individual layers thereof can contain among other things brighteners (Examples in *Research Disclosure* Section V), antifoggants and stabilizers (Examples in *Research Disclosure* Section VI), antistain agents and image dye stabilizers (Examples in *Research Disclosure* Section VII, paragraphs I and J), light absorbing and scattering materials (Examples in *Research Disclosure* Section VIII), hardeners (Examples in *Research Disclosure* Section X), plasticizers and lubricants (Examples in *Research Disclosure* Section XII), antistatic agents (Examples in *Research Disclosure* Section XIII), matting agents (Examples in *Research Disclosure* Section XVI), and development modifiers (Examples in *Research Disclosure* Section XXII).

The photographic elements can be coated on a variety of supports including, but not limited to, those described in *Research Disclosure* Section XVII and the references described therein.

Photographic elements can be exposed to actinic radiation, typically in the visible region of the spectrum, to form a latent image as described in *Research Disclosure* Section XVIII and then processed to form a visible dye image, examples of which are described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

Since the fixing and bleaching are separate steps in the overall process, many alternative processing sequences are compatible with the invention. In the processing of color negative photographic recording materials, these sequences would include a development step prior to a bleaching step, which in turn precedes a fixing step. Combining the bleaching and fixing steps into a bleach-fixing or "blixing" step is contemplated with the invention.

Generally, a stabilization step follows a fixing step. One or more intervening processing steps may come before the development, bleaching, fixing, and/or the stabilization steps. In addition, some processing steps, such as washing steps, may be deleted from the processing cycle. Examples of such modifications to the processing cycle contemplated by the invention include: a pre-solution and/or washing cycle before development; a stop solution, bleach accelerator solution, and/or washing treatment after the development step and before the bleaching step; and omission of the washing steps before and/or after the fixing step. The benefits of this invention can also be realized by placing an additional fixing step between the development step and the bleach step. Conventional techniques for processing are illustrated by *Research Disclosure*, paragraph XIX.

Preferred processing sequences for color photographic elements, particularly color negative films and color print papers, which may be used with this invention, include the following:

(P-1) Color Development / Stop / Bleaching / Washing / Fixing / Washing / Stabilizing / Drying.

(P-2) Color Development / Stop / Bleaching / Fixing / Washing / Stabilizing / Drying.

(P-3) Color Development / Stop-Fixing / Bleaching /

Fixing / Washing / Stabilizing / Drying.

(P-4) Color Development / Bleaching / Washing / Fixing / Washing / Stabilizing / Drying.

While each of the processes described above can be varied, the bleaching step is, in each instance, performed using a peracid-bleaching agent.

The following examples are provided to illustrate the invention and are not intended to limit it in any way.

EXAMPLES

Example 1

Preparation Of Samples 101 Through 114

The Photographic Samples were prepared using known materials and methods.

Photographic Samples 101 to 104 and 112 to 114 were prepared by applying the following layers to a clear support: two red light-sensitive layers in a red sensitive element, two green light-sensitive layers in a green sensitive element, two blue sensitive layers in a blue light-sensitive element along with subbing layers, antihalation and UV-absorbing layers, interlayers, and protective layers as known in the art.

Photographic Sample 105 was prepared by applying the following layers to a clear support: two red light-sensitive layers in a red sensitive element, three green light-sensitive layers in a green sensitive element, two blue sensitive layers in a blue light-sensitive element along with subbing layers, antihalation and UV-absorbing layers, interlayers, and protective layers as known in the art.

Photographic Samples 106 to 109 and 111 were prepared by applying the following layers to a clear support: three red light-sensitive layers in a red sensitive element, three green light-sensitive layers in a green sensitive element, two blue sensitive layers in a blue light-sensitive element along with subbing layers, antihalation and UV-absorbing layers, interlayers, and protective layers as known in the art.

Photographic Sample 110 was prepared by applying the following layers to a clear support: three red light-sensitive layers in a red sensitive element, three green light-sensitive layers in a green sensitive element, three blue sensitive layers in a blue light-sensitive element along with subbing layers, antihalation and UV-absorbing layers, interlayers, and protective layers as known in the art.

The ISO-speed, morphology and silver, halide, and vehicle content of samples 101 through 114 are as described in Table I.

TABLE I

| | Film Composition Features | | | | | | |
|---|---|---|---|---|---|---|---|
| Sample | Silver g/m$^2$ | Average mol % | Iodide Range | Grain Morphology AR & Tabularity Ranges | Vehicle g/m$^2$ | Film Thickness (microns) | ISO Speed |
| 101 | 7.28 | 5.6 | (3.0%–12%) | AR = 2–5, T = 8–33 Conventional | 14.46 | 20.8 | ca. 100 |
| 102 | 7.93 | 3.6 | (1.3%–9%) | AR = 2–25, T = 7–260 Conventional & Tabular | 19.42 | 25.6 | 400 |
| 103 | 9.16 | 4.6 | (2.6%–9%) | AR = 2–27, T = 5–250 Conventional & Tabular | 20.83 | 27.2 | 1600 |
| 104 | 10.17 | 6.7 | (4.8%–12%) | AR = 2–5, T = 14–22 Conventional | 16.40 | 22.9 | 160 |
| 105 | 7.32 | 5.0 | (0.5%–6%) | AR = 1–20, T = 1–100 Tabular & Octahedral | 17.33 | 23.0 | 200 |
| 106 | 3.45 | 3.7 | | AR = 5–15, T = 20–110 Tabular | 15.86 | 20.5 | 200 |
| 107 | 3.45 | 3.7 | | AR = 5–15, T = 20–110 Tabular | 15.86 | 20.5 | 200 |
| 108 | 3.75 | 3.7 | | AR = 5–15, T = 20–110 Tabular | 15.86 | 20.6 | 200 |
| 109 | 3.75 | 3.7 | | AR = 5–15, T = 20–110 Tabular | 15.86 | 20.6 | 200 |
| 110 | 6.69 | 12.5 | (4%–16%) | AR = 2–5, T = 8–20 Conventional | 17.47 | 19.5 | 400 |
| 111 | 7.06 | 3.7 | | AR = 3–25, T = 2–150 Conventional & Tabular | 20.10 | 25.5 | 500 |
| 112 | 6.02 | 3.7 | | AR = 3–25, T = 70–125 Tabular | 17.53 | 22 | 500 |
| 113 | 4.49 | 3.0 | (0.1%–6%) | AR = 1–9, T = 2–110 Cubic & Tabular | 15.66 | 19.5 | 25 |
| 114 | 3.52 | 3.7 | | AR = 3–25, T = 70–125 Tabular | 17.53 | 20.8 | 500 |

mol % I refers to entire photographic material; range shows iodide mol % content of individual emulsions; AR is aspect ratio; T is tabularity; Thickness is from the front surface of the film to the top of the support.

Photographic samples 101 through 114 employed the following image dye-forming couplers, image modifiers, masking couplers, dyes and so forth:

C-1
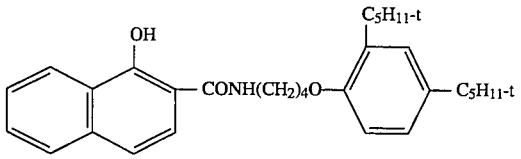
C-2
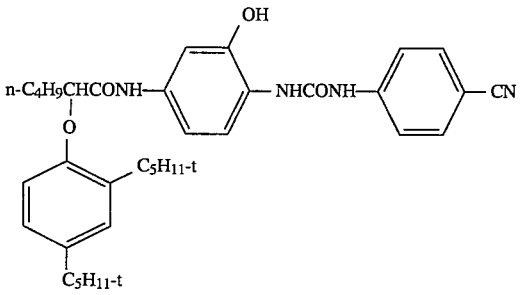
C-3
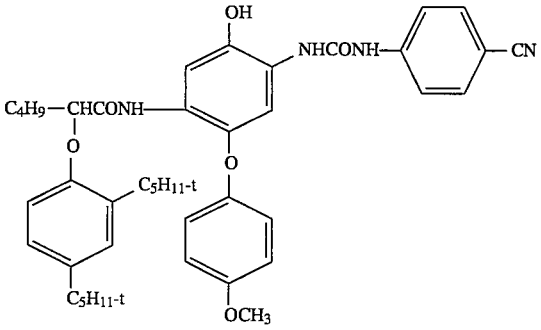
C-4
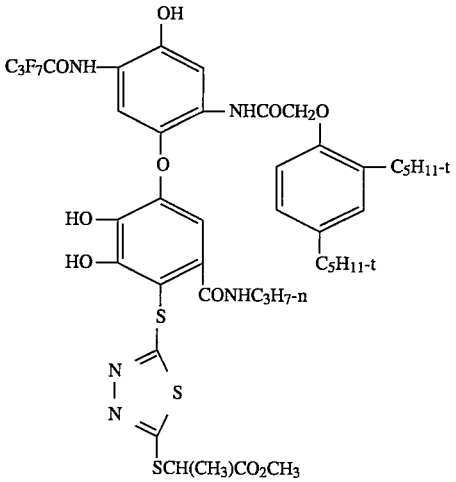
C-5
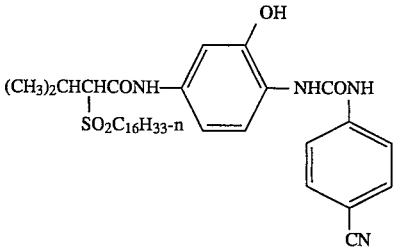
C-6
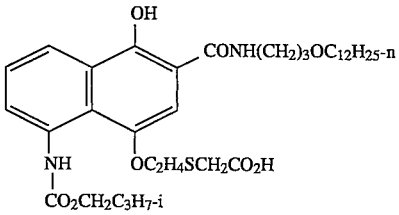
C-7
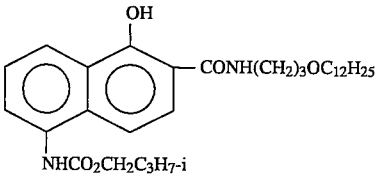
C-8
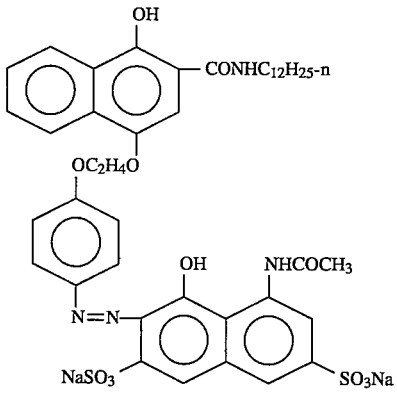

-continued
C-9
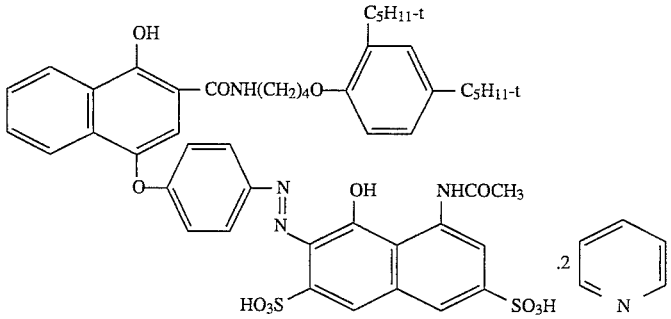
C10
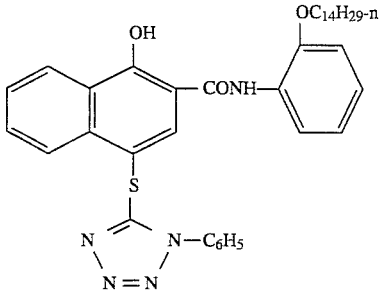
C11
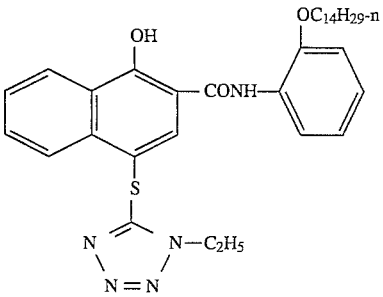
C-12
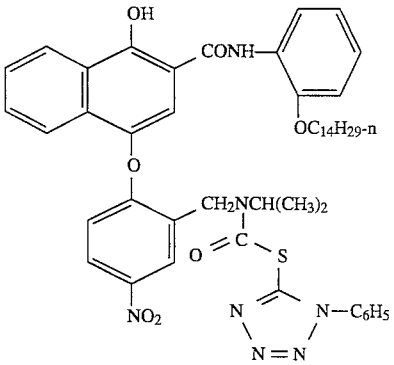
C-13
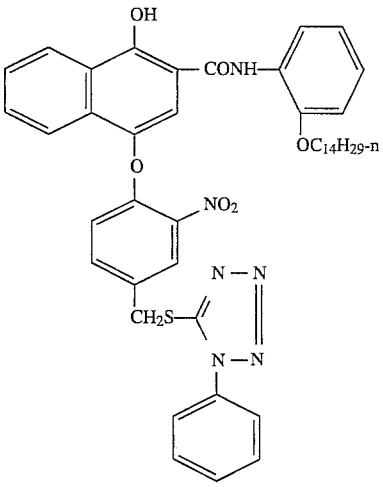
C-14
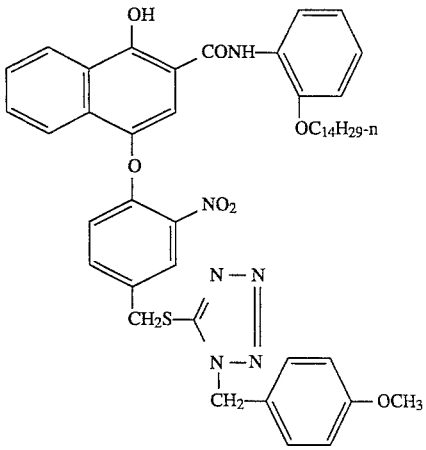
+R2
C-15
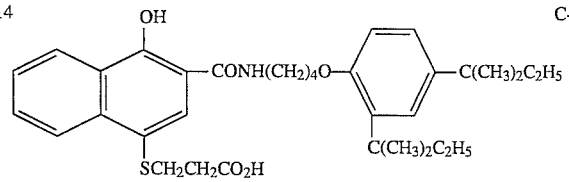

-continued
C-16
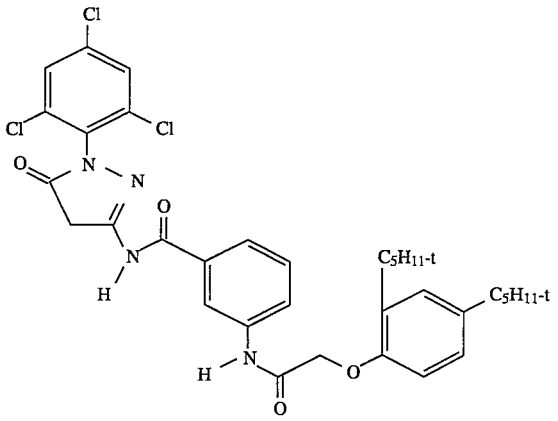
C-17
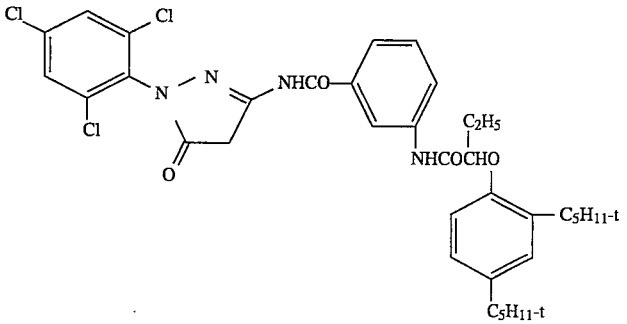
C-18
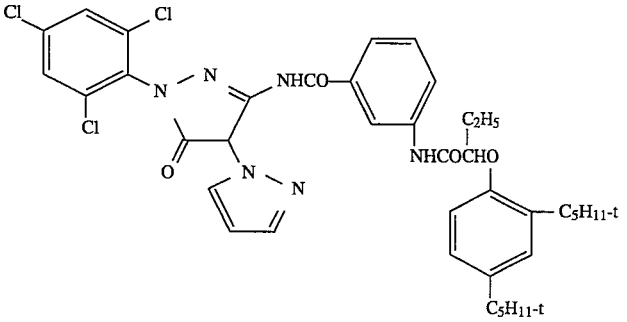
C-19
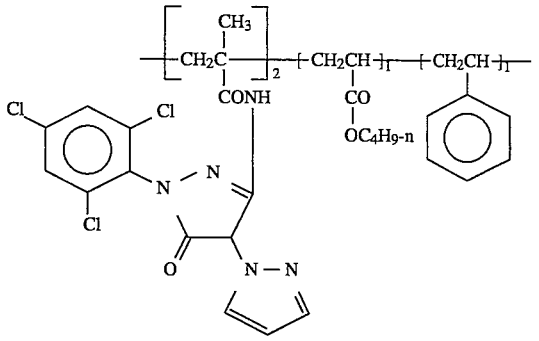

-continued
C-20
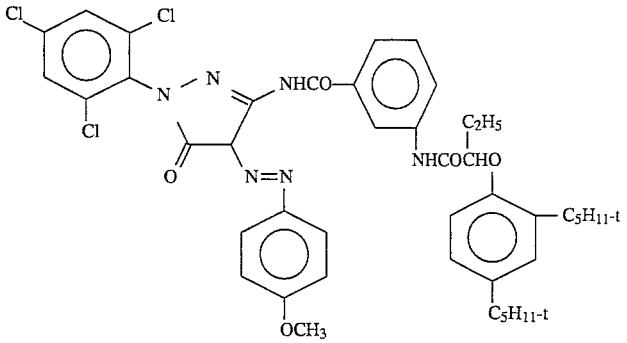
C-21
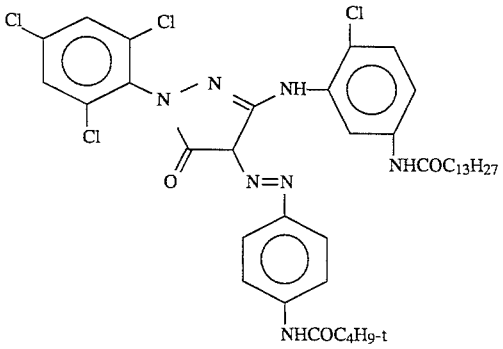
C-22
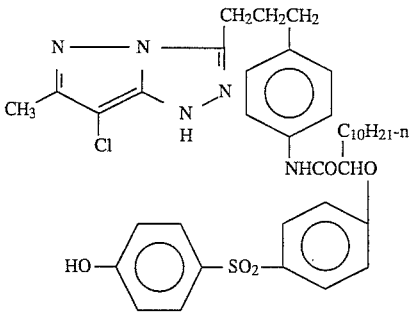
C-23
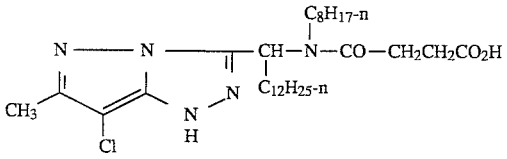
C-24
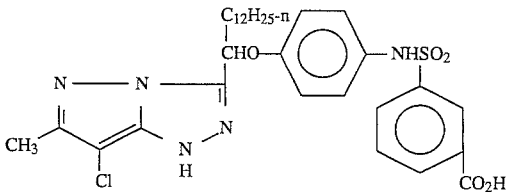
C-25
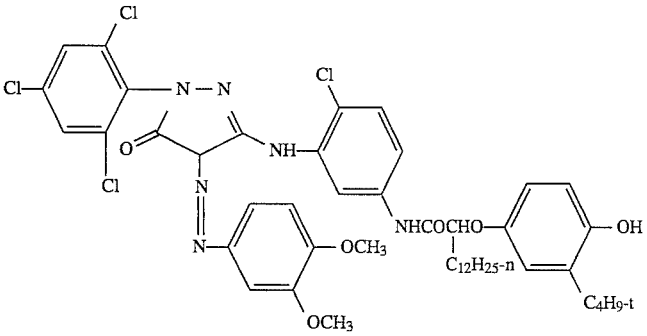
C-26
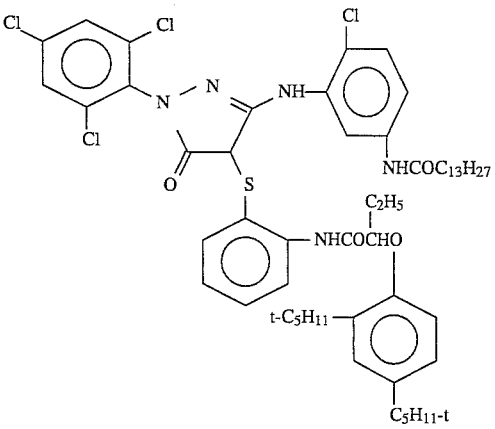

-continued
C-27
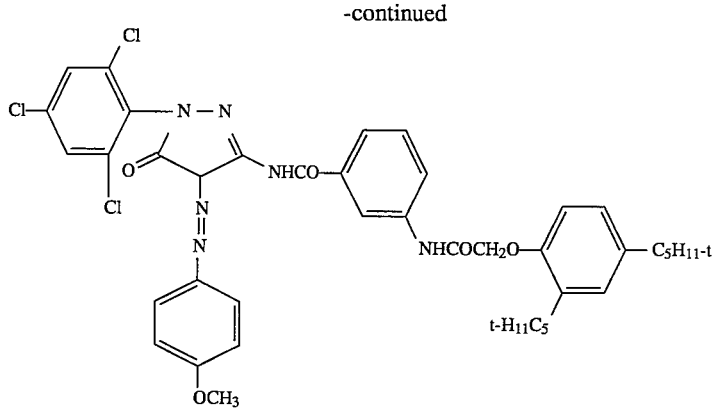
C-28
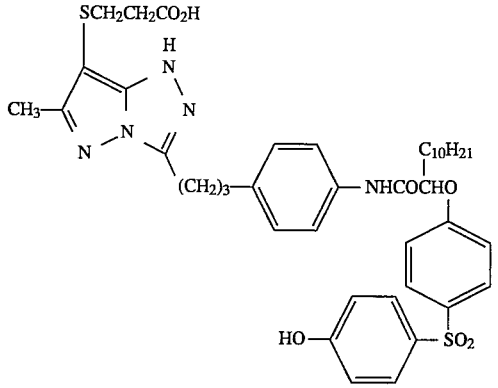
C-29
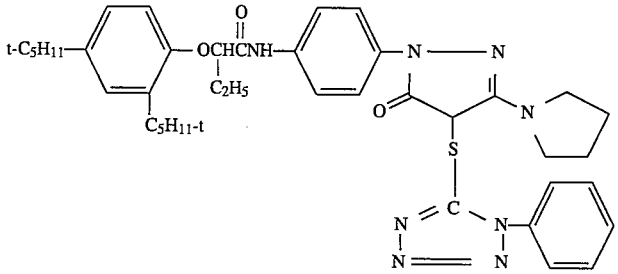
C-30
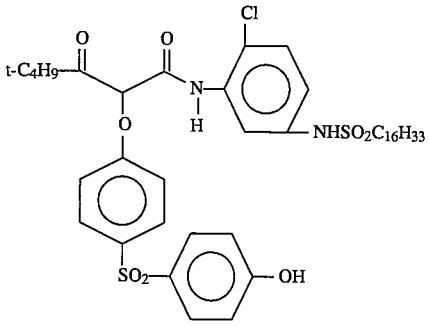
+R2
C-31
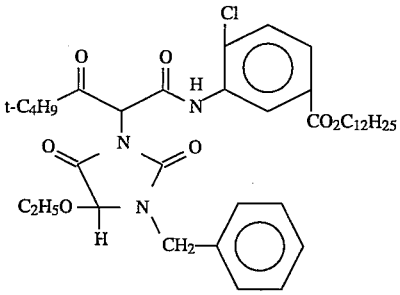

-continued
C-32
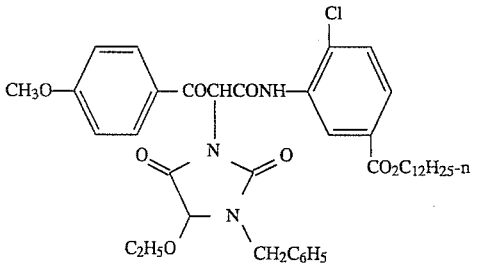
C-33
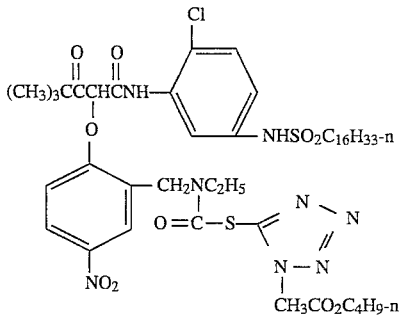
C-34
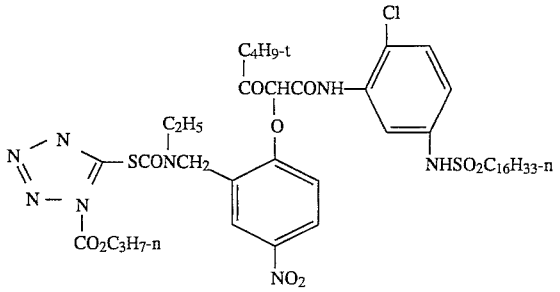
C-35
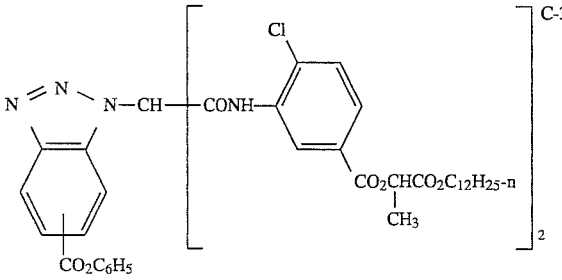
D-1
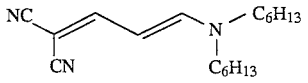
D-2
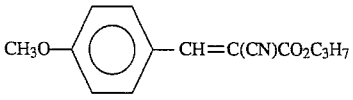
D-3
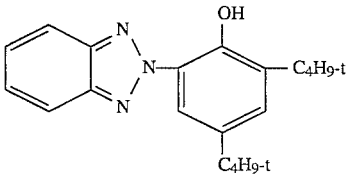
D-4
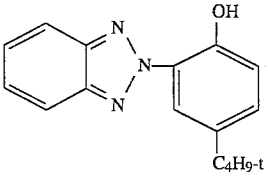
D-5
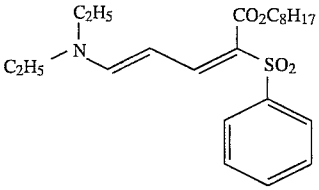
D-6
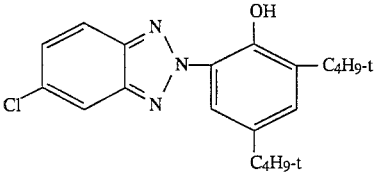
D-7
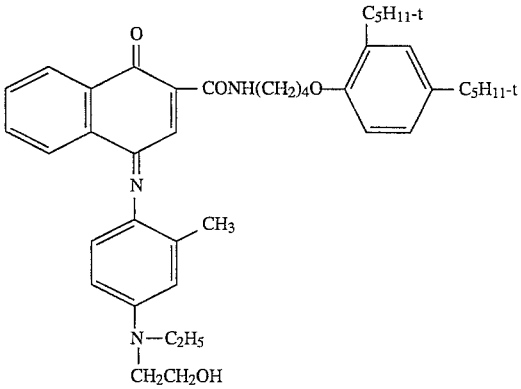

-continued
D-8
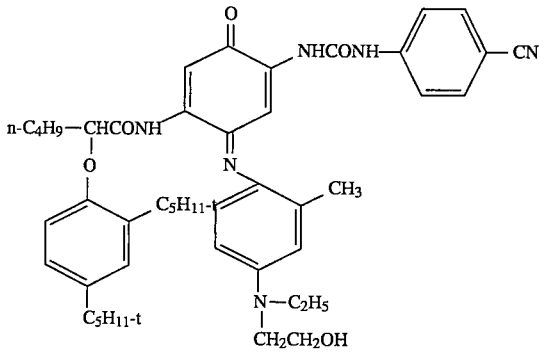
D-9
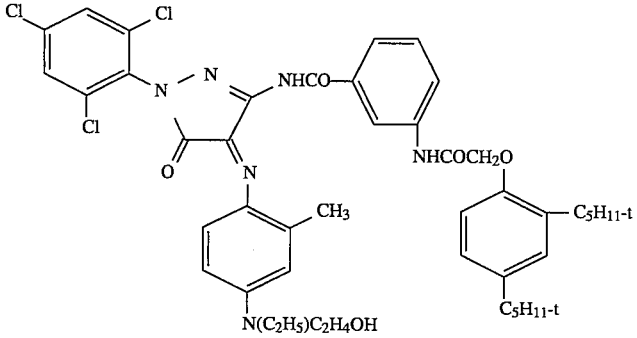
D-10
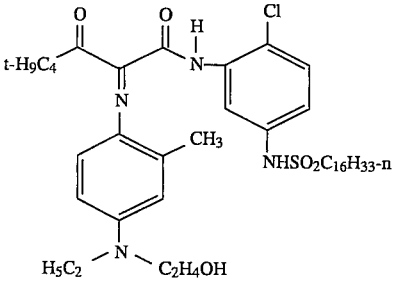
D-11
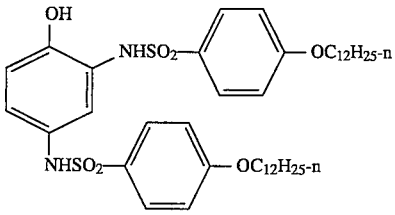
D-12
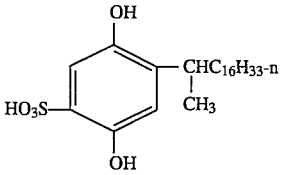
D-13
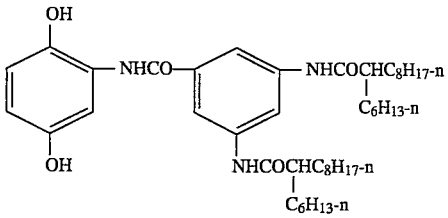
+R2
D-14
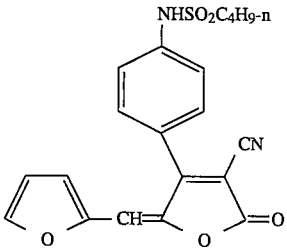
D-15
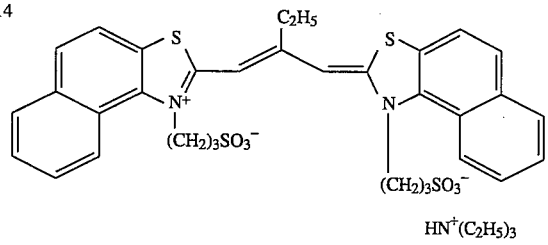

-continued
D-16
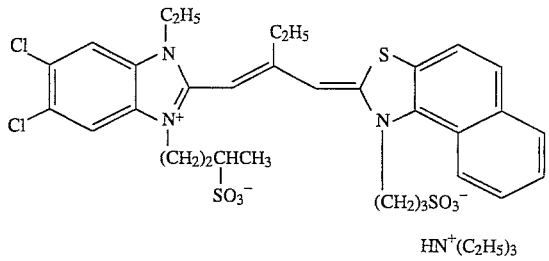
D-17
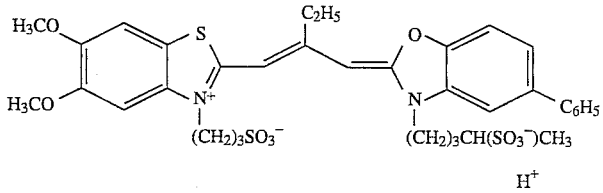
D-18
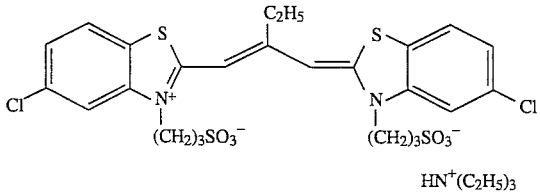
D-19
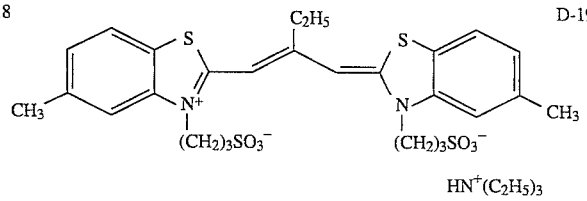
D-20
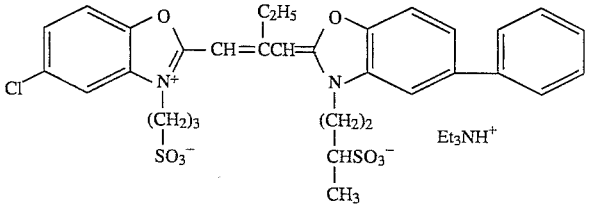
D-21
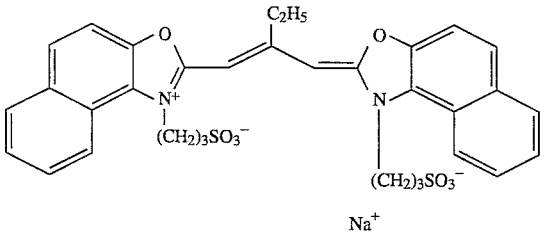
D-22
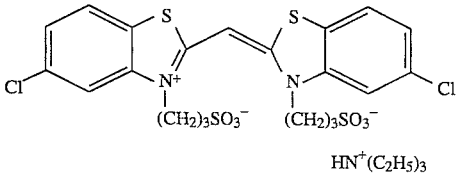
D-23
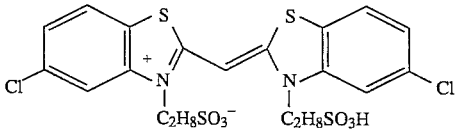
D-24
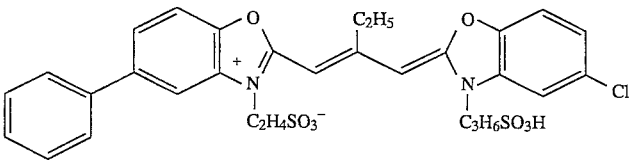
S-1
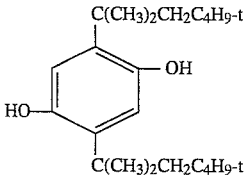
S-2
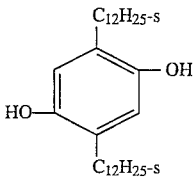

-continued

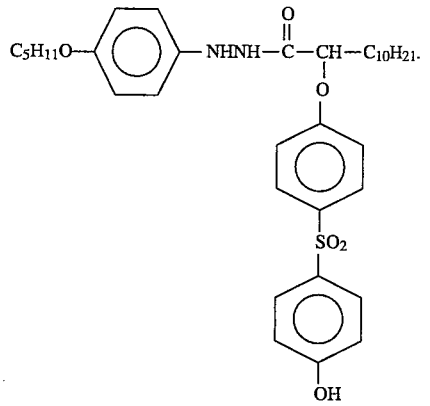

S-3

Example 2

The samples were exposed to light through a gray wedge test object and processed as described below:

| | | | |
|---|---|---|---|
| Process A | | | |
| Develop | 195" | | 38° C. |
| Stop | 60" | | 38° C. |
| Wash | 60" | | 38° C. |
| Bleach | 240" | Fe+++ Bleach | 38° C. |
| Wash | 180" | | 38° C. |
| Fix | Varies | $Na_2S_2O_3$ | 38° C. |
| Wash | | | 38° C. |
| Rinse | | | |
| Process B | | | |
| Develop | 195" | | 38° C. |
| Stop | 60" | | 38° C. |
| Wash | 60" | | 38° C. |
| Accelerator | 60" | | 38° C. |
| Bleach | 240" | Persulfate | 38° C. |
| Wash | 180" | | 38° C. |
| Fix | Varies | $Na_2S_2O_3$ | 38° C. |
| Wash | | | 38° C. |
| Rinse | | | |
| Process C | | | |
| Develop | 195" | | 38° C. |
| Stop | 60" | | 38° C. |
| Wash | 60" | | 38° C. |
| Bleach | 240" | Fe-cat. Persulfate | 38° C. |
| Wash | 180" | | 38° C. |
| Fix | Varies | $Na_2S_2O_3$ | 38° C. |
| Wash | | | 38° C. |
| Rinse | | | |

The process solution compositions were as follows:

| | |
|---|---|
| Developer | |
| Water | 800.00 mL |
| Potassium carbonate, anhydrous | 34.30 g |
| Potassium bicarbonate | 2.32 g |
| Sodium sulfite, anhydrous | 0.38 g |
| Sodium metabisulfite | 2.96 g |
| Potassium iodide | 1.20 mg |
| Sodium bromide | 1.31 g |
| Diethylenetriaminepentaacetic acid pentasodium salt (40% solution) | 8.43 g |
| Hydroxylamine sulfate | 2.41 g |
| KODAK Color Developing Agent CD-4 (N-(4-amino-3-methylphenyl)N-ethyl aminoethanol) | 4.52 g |

-continued

| | |
|---|---|
| Water to make | 1.00 L |
| pH @ 80° F. 10.00 +/− 0.05 | |
| Stop | |
| Water | 900.00 mL |
| Sulfuric acid (18M) | 10.00 mL |
| Water to make | 1.00 L |
| pH @ 80° F. 0.90 | |
| Fe+++ Bleach | |
| Water | 500.00 mL |
| 1,3-propylenediamine tetraacetic acid | 37.40 g |
| 57% ammonium hydroxide | 70.00 mL |
| Acetic acid | 80.00 mL |
| 2-hydroxy-1,3-propylenediamine tetraacetic acid | 37.40 g |
| Ammonium bromide | 25.00 g |
| Ferric nitrate nonahydrate | 44.85 g |
| Water to make | 1.00 L |
| pH 4.75 | |
| Rinse | |
| Water | 900.00 mL |
| 0.5% Aqueous p-tertiary-octyl-(α-phenoxypolyethyl)-alcohol | 3.00 mL |
| Water to make | 1.00 L |
| Accelerator | |
| Water | 800.00 mL |
| Sodium metabisulfite dihydrate | 10.00 g |
| Acetic acid | 25.00 mL |
| Sodium acetate | 10.00 g |
| (Ethylenedinitrilo) tetraacetic acid tetrasodium salt | 0.70 g |
| Dimethylaminoethanethiol isothiouronium salt | 5.50 g |
| Water to make | 1.00 L |
| pH 4.12 @ 98° F. | |
| Persulfate Bleach | |
| Water | 800.00 mL |
| Gelatin hydrolysate | 0.50 g |
| Sodium persulfate | 33.00 g |
| Sodium chloride | 15.00 g |
| Sodium dihydrogen phosphate | 10.35 g |
| Phosphoric acid (85% solution) | 2.50 mL |
| pH @ 80° F. 2.3 +/− 0.2 (adj w/phosphoric acid) | |
| Water to make | 1.00 L |
| Fe-catalyzed Persulfate Bleach | |
| Water | 800.00 mL |
| 2,6-Pyridinedicarboxylic Acid | 4.60 g |
| Ferric nitrate nonahydrate | 5.05 g |
| Sodium persulfate | 59.50 g |
| Sodium chloride | 8.75 g |
| Acetic acid | 5.72 mL |
| Ammonium hydroxide | 10.00 mL |
| pH @ 78° F. 4.0 (adj. w/sodium hydroxide) | |
| Water to make | 1.00 L |
| Sodium Thiosulfate Fix | |

-continued

| | |
|---|---|
| Sodium thiosulfate pentahydrate | 204.70 g |
| Sodium bisulfite dihydrate | 17.10 g |
| pH @ 78° F. 6.52 (adj. w/sodium hydroxide) | |
| Water to make | 1.00 L |

The quantity of silver retained in the various photographic samples at a Dmax exposure was monitored after processing using X-ray fluorescence techniques. These quantities are reported in Table II below. Also reported in Table II are the contact times (expressed in seconds) of the various photographic samples tested with the fixer solutions. The fixer solution employed in all of these experiments has a concentration of 0.825 mole of thiosulfate per liter (e.g., 0.825M).

TABLE II

Photographic Sample, Process Identity, Fixer Solution Contact Time And Quantity Of Silver Retained After Processing At A Dmax Exposure

| Photographic Sample | Process | Time Of Fix (in seconds) | Silver At Dmax (in g/m**2) |
|---|---|---|---|
| 101 (Control) | A | 20 | 3.615 |
| 101 (Control) | A | 40 | 2.163 |
| 101 (Control) | A | 60 | 0.652 |
| 101 (Control) | A | 120 | 0.028 |
| 101 (Control) | A | 240 | 0.039 |
| 101 | B | 20 | 1.679 |
| 101 | B | 40 | 0.733 |
| 101 | B | 60 | 0.425 |
| 101 | B | 120 | 0.031 |
| 101 | B | 240 | 0.029 |
| 101 | C | 20 | 3.239 |
| 101 | C | 40 | 1.410 |
| 101 | C | 60 | 0.196 |
| 101 | C | 120 | 0.049 |
| 101 | C | 240 | 0.041 |
| 102 (Control) | A | 20 | 4.003 |
| 102 (Control) | A | 40 | 2.174 |
| 102 (Control) | A | 60 | 0.938 |
| 102 (Control) | A | 120 | 0.059 |
| 102 (Control) | A | 240 | 0.015 |
| 102 | B | 20 | 2.668 |
| 102 | B | 40 | 0.718 |
| 102 | B | 60 | 0.469 |
| 102 | B | 120 | 0.099 |
| 102 | B | 240 | 0.020 |
| 102 | C | 20 | 3.605 |
| 102 | C | 40 | 1.797 |
| 102 | C | 60 | 0.843 |
| 102 | C | 120 | 0.029 |
| 102 | C | 240 | 0.012 |
| 103 (Control) | A | 20 | 4.465 |
| 103 (Control) | A | 40 | 2.636 |
| 103 (Control) | A | 60 | 1.399 |
| 103 (Control) | A | 120 | 0.031 |
| 103 (Control) | A | 240 | 0.029 |
| 103 | B | 20 | 2.959 |
| 103 | B | 40 | 1.023 |
| 103 | B | 60 | 0.523 |
| 103 | B | 120 | 0.145 |
| 103 | B | 240 | 0.020 |
| 103 | C | 20 | 3.970 |
| 103 | C | 40 | 2.389 |
| 103 | C | 60 | 1.237 |
| 103 | C | 120 | 0.023 |
| 103 | C | 240 | 0.025 |
| 104 (Control) | A | 30 | 5.176 |
| 104 (Control) | A | 60 | 3.131 |
| 104 (Control) | A | 120 | 0.549 |
| 104 (Control) | A | 240 | 0.022 |
| 104 | B | 30 | 2.970 |
| 104 | B | 60 | 0.834 |
| 104 | B | 120 | 0.238 |

TABLE II-continued

Photographic Sample, Process Identity, Fixer Solution Contact Time And Quantity Of Silver Retained After Processing At A Dmax Exposure

| Photographic Sample | Process | Time Of Fix (in seconds) | Silver At Dmax (in g/m**2) |
|---|---|---|---|
| 104 | B | 240 | 0.001 |
| 105 (Control) | A | 30 | 1.937 |
| 105 (Control) | A | 60 | 1.205 |
| 105 (Control) | A | 120 | 0.013 |
| 105 (Control) | A | 240 | 0.028 |
| 105 | B | 30 | 1.506 |
| 105 | B | 60 | 0.387 |
| 105 | B | 120 | 0.133 |
| 105 | B | 240 | 0.000 |
| 106 | B | 30 | 0.524 |
| 106 | B | 60 | 0.083 |
| 106 | B | 120 | 0.038 |
| 106 | B | 240 | 0.022 |
| 107 | B | 30 | 0.543 |
| 107 | B | 60 | 0.059 |
| 107 | B | 120 | 0.058 |
| 107 | B | 240 | 0.000 |
| 108 | B | 30 | 0.533 |
| 108 | B | 60 | 0.104 |
| 108 | B | 120 | 0.090 |
| 108 | B | 240 | 0.015 |
| 109 | B | 30 | 0.520 |
| 109 | B | 60 | 0.104 |
| 109 | B | 120 | 0.097 |
| 109 | B | 240 | 0.031 |
| 110 (Control) | A | 10 | 3.488 |
| 110 (Control) | A | 20 | 2.747 |
| 110 | B | 10 | 1.309 |
| 110 | B | 25 | 1.116 |
| 111 (Control) | A | 10 | 4.555 |
| 111 (Control) | A | 20 | 3.451 |
| 111 (Control) | A | 30 | 2.511 |
| 111 (Control) | A | 40 | 1.655 |
| 111 (Control) | A | 60 | 0.717 |
| 111 (Control) | A | 120 | 0.036 |
| 111 (Control) | A | 240 | 0.026 |
| 111 | B | 10 | 3.374 |
| 111 | B | 25 | 1.577 |
| 111 | B | 35 | 0.630 |
| 111 | B | 45 | 0.682 |
| 111 | B | 60 | 0.601 |
| 111 | B | 120 | 0.145 |
| 111 | B | 240 | 0.021 |
| 112 (Control) | A | 10 | 3.995 |
| 112 (Control) | A | 20 | 2.906 |
| 112 (Control) | A | 30 | 1.920 |
| 112 (Control) | A | 40 | 1.229 |
| 112 (Control) | A | 60 | 0.200 |
| 112 (Control) | A | 120 | 0.046 |
| 112 (Control) | A | 240 | 0.036 |
| 112 | B | 10 | 2.606 |
| 112 | B | 25 | 0.649 |
| 112 | B | 35 | 0.532 |
| 112 | B | 45 | 0.500 |
| 112 | B | 60 | 0.370 |
| 112 | B | 120 | 0.072 |
| 112 | B | 240 | 0.031 |
| 113 (Control) | A | 10 | 2.551 |
| 113 (Control) | A | 20 | 1.714 |
| 113 (Control) | A | 30 | 1.062 |
| 113 (Control) | A | 40 | 0.550 |
| 113 (Control) | A | 60 | 0.032 |
| 113 (Control) | A | 120 | 0.021 |
| 113 (Control) | A | 240 | 0.019 |
| 113 | B | 10 | 1.513 |
| 113 | B | 25 | 0.518 |
| 113 | B | 35 | 0.555 |
| 113 | B | 45 | 0.469 |
| 113 | B | 60 | 0.270 |
| 113 | B | 120 | 0.060 |
| 113 | B | 240 | 0.019 |
| 114 (Control) | A | 10 | 1.511 |

TABLE II-continued

| Photographic Sample, Process Identity, Fixer Solution Contact Time And Quantity Of Silver Retained After Processing At A Dmax Exposure | | | |
|---|---|---|---|
| Photographic Sample | Process | Time Of Fix (in seconds) | Silver At Dmax (in g/m**2) |
| 114 (Control) | A | 20 | 0.704 |
| 114 (Control) | A | 30 | 0.193 |
| 114 (Control) | A | 40 | 0.050 |
| 114 (Control) | A | 60 | 0.036 |
| 114 (Control) | A | 120 | 0.046 |
| 114 (Control) | A | 240 | 0.031 |
| 114 | B | 10 | 0.511 |
| 114 | B | 25 | 0.400 |
| 114 | B | 35 | 0.341 |
| 114 | B | 45 | 0.152 |
| 114 | B | 60 | 0.060 |
| 114 | B | 120 | 0.053 |
| 114 | B | 240 | 0.028 |

As can be readily appreciated upon examination of the comparative data provided in Table II above for the fixing of the photographic samples, contact with a peracid bleach solution before contact with a sodium salt fixer solution results in an unexpected improvement in the efficacy of fixing of the photographic samples relative to that shown in the control process A. This illustrates the practical advantage of being able to employ an ecologically sound sodium salt fixer solution for a shorter period of time or at a lower concentration than would be expected. This unexpected advantage holds true both when an accelerated peracid bleach solution is used as in process B or when a metal catalyzed peracid bleach solution is used as in process C, before the photographic sample contacts the fixer solution. This unexpected advantage is especially apparent under milder fixing conditions than are described in the art.

The high iodide content films, samples 101, 104, and 110 show a large advantage in fixing when using the preferred combination of a peracid bleach and a sodium thiosulfate fix. This acceleration with the high iodide content photographic samples is especially surprising when one considers that high iodide content photographic materials are traditionally considered difficult to fix.

Table III further illustrates the fixing advantages of this invention.

TABLE III

| Relative Fixing Rates | | | |
|---|---|---|---|
| | | Time To Remove | |
| Sample | Process | 75% Of Silver | 90% Of Silver |
| 101 | A (Control) | 44 Sec | 59 Sec |
| | B | 19 Sec | 41 Sec |
| | C | 34 Sec | 51 Sec |
| 102 | A (Control) | 43 Sec | 70 Sec |
| | B | 27 Sec | 38 Sec |
| | C | 38 Sec | 62 Sec |
| 103 | A (Control) | 44 Sec | 80 Sec |
| | B | 27 Sec | 48 Sec |
| | C | 41 Sec | 69 Sec |
| 104 | A (Control) | 74 Sec | 130 Sec |
| | B | 36 Sec | 58 Sec |
| 105 | A (Control) | 34 Sec | 82 Sec |
| | B | 28 Sec | 53 Sec |
| 110 | A (Control) | 34 Sec | 49 Sec |
| | B | 9 Sec | 43 Sec |

TABLE III-continued

| Relative Fixing Rates | | | |
|---|---|---|---|
| | | Time To Remove | |
| Sample | Process | 75% Of Silver | 90% Of Silver |
| 111 | A (Control) | 38 Sec | 61 Sec |
| | B | 24 Sec | 34 Sec |
| 112 | A (Control) | 37 Sec | 53 Sec |
| | B | 18 Sec | 30 Sec |
| 113 | A (Control) | 29 Sec | 45 Sec |
| | B | 17 Sec | 45 Sec |
| 114 | A (Control) | 18 Sec | 28 Sec |
| | B | 9 Sec | 27 Sec |

Example 3

Samples 110 through 114 were processed using simulated seasoned processing solutions and similar results were obtained, e.g., the combination of a peracid bleach followed by a high sodium thiosulfate fix resulted in rapid fixing of the photographic samples.

This invention has been described in detail with particular reference to preferred embodiments thereof, but it will be understood that variations and modifications can be effected within the spirit and scope of the invention.

What is claimed is:

1. A method of desilvering an imagewise exposed, developed color negative silver halide element, said method comprising bleaching the photographic element with a peracid bleach comprising a chloride salt and a peracid bleaching agent, and subsequently contacting the photographic element with a fixer solution comprising thiosulfate anion and sodium cation;

wherein the photographic element has an iodide content of greater than 5.5 mole % based on incorporated silver; and wherein the fixer solution has an ammonium ion content of less than 1.4M, said contacting time of said element with said fixer solution being less than 300 seconds.

2. The method of claim 1 wherein the photographic element is bleached in the peracid bleach in the presence of a bleach accelerator.

3. The method of claim 1 wherein the peracid bleach comprises a persulfate or peroxide moiety.

4. The method of claim 1 wherein the photographic element comprises less than 20 grams of incorporated silver per square meter.

5. The method of claim 1 wherein the fixer solution has an ammonium ion concentration of less than 0.9M.

6. The method of claim 1 wherein the fixer solution has an ammonium ion concentration of less than 0.75M.

7. The method of claim 1 wherein the fixer solution is substantially free of ammonium cation.

8. The method of claim 2 wherein the peracid bleach is sodium persulfate.

9. The method of claim 1 wherein the photographic element comprises silver halide grains having an aspect ratio of about 1 to about 5.

10. A method of desilvering an imagewise exposed, developed color negative silver halide element, said method comprising bleaching the photographic element with a persulfate bleach in the presence of a bleach accelerator, said persulfate bleach comprising a chloride salt and a persulfate bleaching agent, and subsequently contacting the photographic element with a fixer solution comprising thiosulfate anion and sodium cation;

wherein the photographic element has an iodide content of greater than 5.5 mole % based on incorporated silver; and wherein the fixer solution contains less than 0.75M ammonium ion, said contacting time of said element with said fixer solution being less than 300 seconds.

11. The method of claim 10 wherein the fixer solution contains substantially no ammonium ion.

12. The method of claim 10 wherein the persulfate bleach is sodium persulfate.

13. The method of claim 10 wherein the photographic element comprises silver halide grains having an aspect ratio of about 1 to about 5.

14. A method of desilvering an imagewise exposed, developed color negative silver halide element, said method comprising bleaching the photographic element with a sodium persulfate bleach in the presence of a bleach accelerator, said persulfate bleach comprising a chloride salt and a persulfate bleaching agent, and subsequently contacting the photographic element with a fixer solution comprising thiosulfate anion and sodium cation;

wherein the photographic element has an iodide content of greater than 5.5 mole % based on incorporated silver; and wherein the fixer solution contains no ammonium ion, said contacting time of said element with said fixer solution being less than 300 seconds.

15. The method of claim 14 wherein the photographic element comprises silver halide grains having an aspect ratio of about 1 to about 5.

16. A method of desilvering an imagewise exposed, developed color negative silver halide element, said method comprising bleaching the photographic element with a peracid bleach comprising a peracid bleaching agent and a chloride salt, and subsequently contacting the photographic element with a fixer solution comprising thiosulfate anion and sodium cation;

wherein the photographic element has an iodide content of greater than 5.5 mole % based on incorporated silver; and wherein the fixer solution has an ammonium ion content of less than 1.4M.

* * * * *